US007192244B2

(12) United States Patent
Grande, III et al.

(10) Patent No.: US 7,192,244 B2
(45) Date of Patent: Mar. 20, 2007

(54) BLADELESS CONICAL RADIAL TURBINE AND METHOD

(76) Inventors: Salvatore F. Grande, III, P.O. Box 1010, Bayfield, CO (US) 81122; David R. Draper, 7545 Breen St., Houston, TX (US) 77086

( * ) Notice: Subject to any disclaimer, the term of this patent is extended or adjusted under 35 U.S.C. 154(b) by 120 days.

(21) Appl. No.: 11/030,467

(22) Filed: Jan. 6, 2005

(65) Prior Publication Data

US 2005/0214109 A1 Sep. 29, 2005

(51) Int. Cl.
*F01D 1/36* (2006.01)

(52) U.S. Cl. ..... 415/90; 415/226; 415/206; 416/198 R

(58) Field of Classification Search ..... 415/90, 415/224, 226, 206, 227; 416/198 R, 201 R
See application file for complete search history.

(56) References Cited

U.S. PATENT DOCUMENTS

| | | | | |
|---|---|---|---|---|
| 651,400 | A | 6/1900 | Trouve et al. | |
| 1,056,338 | A | 3/1913 | Johnsen | |
| 1,061,142 | A | 5/1913 | Tesla | |
| 1,061,206 | A | 5/1913 | Tesla | |
| 1,865,503 | A | 7/1932 | Biggs | |
| 1,989,966 | A | 2/1935 | Biggs | |
| 2,087,834 | A | 7/1937 | Brown et al. | |
| 2,222,618 | A | 11/1940 | Jandasek | |
| 2,271,919 | A | 2/1942 | Jandasek | |
| 2,609,141 | A | 9/1952 | Aue | |
| 2,655,868 | A | 10/1953 | Lindau et al. | |
| 3,212,265 | A | 10/1965 | Nueber | |
| 3,228,344 | A | 1/1966 | Cooper | |
| 3,234,716 | A * | 2/1966 | Sevin et al. | 210/360.1 |
| 3,356,033 | A | 12/1967 | Ullery | |
| 3,392,675 | A | 7/1968 | Taylor | |
| 3,478,691 | A | 11/1969 | Henry, IV | |
| 3,738,773 | A | 6/1973 | Tinker | |
| 4,025,225 | A * | 5/1977 | Durant | 415/90 |
| 4,036,584 | A * | 7/1977 | Glass | 415/90 |
| 4,218,176 | A | 8/1980 | Gawne | |
| 4,232,992 | A | 11/1980 | Possell | |

(Continued)

FOREIGN PATENT DOCUMENTS

EP 0 002 592 A1 6/1979

(Continued)

OTHER PUBLICATIONS

PCT International Search Report and Written Opinion for International Application No. PCT/US2005/02398, date of mailing—Oct. 20, 2006.

*Primary Examiner*—Ninh H. Nguyen
(74) *Attorney, Agent, or Firm*—Kenneth L. Nash

(57) ABSTRACT

Turbo-machinery and methods are disclosed for a bladeless conical radial turbine wherein fluid is directed axially within the pump body to produce an axial output. The rotor comprises a plurality of spaced apart conical elements. A plurality of spiraling flow paths may be provided to receive fluid to which fluid has been imparted by acceleration of the fluid through the spaces between the conical elements using boundary layer adhesion techniques. The fluid is smoothly directed to any number of subsequent boundary layer pumping stages which are axially positioned with respect to each other.

31 Claims, 5 Drawing Sheets

U.S. PATENT DOCUMENTS

| | | | | |
|---|---|---|---|---|
| 4,239,453 | A | 12/1980 | Hergt et al. | |
| 4,280,791 | A | 7/1981 | Gawne | |
| 4,372,731 | A | 2/1983 | Fonda-Bonardi | |
| 4,378,703 | A | 4/1983 | Furness et al. | |
| 4,403,911 | A | 9/1983 | Possell | |
| 4,416,582 | A | 11/1983 | Glass | |
| 4,417,877 | A | 11/1983 | Krautkremer et al. | |
| 4,586,871 | A | 5/1986 | Glass | |
| 4,652,207 | A | 3/1987 | Brown et al. | |
| 5,363,653 | A | 11/1994 | Zimmermann et al. | |
| 5,388,958 | A | 2/1995 | Dinh | |
| 5,406,796 | A | 4/1995 | Hiereth et al. | |
| 5,470,197 | A | 11/1995 | Cafarelli | |
| 5,518,363 | A | 5/1996 | Theis | |
| 6,224,325 | B1 | 5/2001 | Conrad et al. | |
| 6,227,796 | B1 * | 5/2001 | Markovitch | 415/90 |
| 6,354,318 | B2 | 3/2002 | Butler | |
| 6,368,078 | B1 | 4/2002 | Palumbo | |
| 6,503,067 | B2 | 1/2003 | Palumbo | |
| 6,506,025 | B1 | 1/2003 | Gharib | |
| 6,582,208 | B2 | 6/2003 | Gharib | |
| 6,595,762 | B2 | 7/2003 | Khanwilkar et al. | |
| 6,682,077 | B1 | 1/2004 | Letourneau | |
| 6,692,232 | B1 | 2/2004 | Letourneau | |
| 6,726,442 | B2 | 4/2004 | Letourneau | |
| 6,726,443 | B2 | 4/2004 | Collins et al. | |
| 6,752,597 | B2 | 6/2004 | Pacello et al. | |
| 6,798,080 | B1 | 9/2004 | Baarman et al. | |
| 2002/0119040 | A1 | 8/2002 | Bosley | |
| 2004/0136846 | A1 | 7/2004 | Gharib | |

FOREIGN PATENT DOCUMENTS

| | | |
|---|---|---|
| EP | 0 846 844 B1 | 6/1998 |
| EP | 0 607 320 B1 | 10/2001 |
| GB | 381193 | 10/1932 |
| GB | 578115 | 6/1946 |
| WO | WO 1999/036687 | 7/1999 |
| WO | WO 2000/079129 | 12/2000 |
| WO | WO 2001/042653 | 6/2001 |
| WO | WO 2004/008829 | 1/2004 |

* cited by examiner

BLADELESS CONICAL RADIAL TURBINE AND METHOD

FIELD OF THE INVENTION

The present invention relates generally to turbo-machinery and, more particularly, to bladeless or boundary layer turbines such as turbine pumps, engines, drivers, and the like.

BACKGROUND OF THE INVENTION

Boundary layer or bladeless turbines, pumps, and other related turbo-machinery have been known and patented as early as May 6, 1913 when Nikola Tesla described a boundary layer pump in U.S. Pat. No. 1,061,142. The boundary layer pump taught in that patent utilizes rotating flat disks which have no blades, vanes, or propellers, so that such pumps are now also referred to as bladeless pumps. In related U.S. Pat. No. 1,061,206, Tesla disclosed a fluid driven boundary layer or bladeless turbine which may be utilized as a prime mover, such as a hydro-electric power generator for transforming kinetic energy in flowing fluids into electrical energy. Another example of related boundary layer or bladeless turbo-machinery invented by Tesla, and described in U.S. Pat. No. 1,329,559, shows a boundary layer or bladeless turbine implemented as an internal combustion engine wherein one or more combustion chambers may be substantially continuously fed with fuel and air to thereby produce expanding hot gases which drive the turbine.

One embodiment of the present invention describes a bladeless conical radial turbine as it applies to fluid pumping problems. However, it will be understood that general mechanical structures utilized in the bladeless conical radial turbine of the present invention may be implemented in various types of turbo-machinery and the present invention is not intended to be limited to a particular type of turbine implementation.

Unlike more traditional pumps which utilize vanes, blades, augurs, buckets, pistons, gears, diaphragms, and the like, boundary layer pumps, such as those described by Tesla, may typically utilize multiple rotating parallel flat disks. Bladeless or boundary layer pumps operate to pump fluids by utilizing the fluid properties of adhesion and viscosity. These fluid properties create an interaction between the fluid and the rotating flat disks of the boundary layer or bladeless pump whereby the mechanical energy of the rotating turbine may be imparted to the fluid to induce the fluid to flow through the pump housing.

Boundary layer pumps, some of which are discussed in greater detail hereinafter, have been reported to have some significant advantages over the more traditional pumps especially when utilized for pumping fluids other than cool, clean, homogenous liquids. The vanes, buckets, or the like, of traditional pumps wear and lose effectiveness due to normal friction and/or impingement with particles such as sand or other abrasives. However, the flat surfaces of boundary layer pumps are much less susceptible to wear and may have little or no wear even after extended use. Boundary layer pumps have been found to be especially effective for pumping high viscosity fluids wherein the efficiency of such pumps may actually increase as the fluid viscosity increases. Boundary layer pumps have also been reported to be more cost effective in terms of reliability and decreased downtime for pumping problematic multiphase fluids, which may comprise gases, liquids, and/or solid materials. Boundary layer pumps have been found to greatly reduce maintenance costs and downtime when used to replace more traditional pumps. Moreover, the tolerances of the flat disks for boundary layer pumps tend to be much looser than those required for operation of more traditional pumps thereby resulting in higher reliability. Traditional centrifugal pumps rely on narrow internal clearances with close tolerances to maintain the pressure in the pump needed for maximum efficiency. These tolerances may wear away quickly in abrasive fluid pumping service so that these traditional design pumps steadily lose efficiency and eventually fail. Traditional pump manufacturers sometimes make more income from replacement components due to wear and failure from operating in a harsh pumping environment than on the sales of original pumps.

Due to the absence of spinning blades or impellers, boundary layer pumps are more gentle on sensitive fluids pumped e.g. shear-sensitive fluids. As an example, boundary layer pumps have been found to pump water containing live fish without harming the fish.

Other problems related to traditional axial, centrifugal, and mixed flow pumps include problems relating to cavitation. Cavitation describes a vacuum-like condition in the pump which can occur when liquid in the low-pressure area of the pump vaporizes. Vapor bubbles implode as they pass to regions of high pressure and can create a shock wave powerful enough to lift metal off the pump. The energy required to accelerate the liquid to high velocity and fill the void left by the bubbles causes a drop in capacity. In a boundary layer pump, because the fluid flow changes are kept as gradual as possible, with laminar flow rather than turbulent flow, the risk of cavitation is greatly reduced.

As discussed briefly above, impingement damage is produced by solids which engage the vanes of a pump and erode it. The higher the angle of impingement between the particle and the vane, the greater the damage, with a ninety degree impingement angle being the most damaging. Traditional pumps are sometimes operated at lower speeds to reduce impingement wear, but lower speeds result in lower fluid flow and lower horsepower. In a boundary layer pump, with smooth disks, the impingement damage is eliminated or substantially eliminated due to laminar flow over the disks with a zero degree impingement angle. Boundary layer pumps can be operated at high speeds virtually without impingement damage.

Other problems related to more traditional pumps include vapor lock problems, and pump efficiencies being limited by affinity laws. The flow to head ratio is often restricted by design limitations in traditional pumps. Turbulent flow in the stage to stage transition can be problematic. The down thrust loading developed in some applications can be excessive. Radial and side loading thrust is often inconsistent relative to rotational speed. Upon startup, upthrust can be detrimental to the ultimate balance of the pump. Stated more generally, traditional pumps are highly subject to vibrations as a natural result of impact of the vanes and blades with the fluids pumped. This vibration problem is highly exacerbated when multiphase fluids are pumped that may include solids, liquids, and gases. Accordingly, the shaft rotation speed of traditional pumps, especially those used for pumping multiphase fluids, is limited to avoid destroying the pump due to vibrational damage. The limited shaft rotational speeds result in lower pump output, limited horsepower, and generally less pumping capability. On the other hand, boundary layer pumps, such as the Tesla pump, use flat smooth disks which may be easily balanced and produce little or no vibration when spinning within a fluid even at relatively much higher rotational speeds. Typical boundary layer pumps do not utilize lifting surfaces on the rotating elements. Higher rotational speed is directly related to pump flow rates so that boundary layer pumps permit significantly increased pump rotation speeds when pumping multiphase fluids which may contain solids, liquids, and gases. Moreover, boundary layer pumps have been found to not only increase the output under these difficult pumping conditions as compared to traditional pumps, but also have been found to be much more reliable.

Despite the many advantages of boundary layer pumps over more traditional pumps for pumping multiphase fluids, some of which are discussed above, and despite commercial usage and considerable interest in boundary layer pumps since their invention by Tesla in 1913, solutions to certain multiphase fluid pumping problems utilizing boundary layer pumps have never been found. One example of such pumping problems is found in the oilfield, where it is desirable that multiphase hydrocarbon fluids be pumped in a continuously upward direction from the production zone of a well through a relatively small wellbore to the surface. In pumps for wellbores, it is therefore desirable that the pump have a small diameter to fit within the wellbore. Moreover, pumps with an axial discharge are more efficient for moving the fluid up the borehole within the confined space of the wellbore and/or production tubing. Despite the long felt need for the advantages of a boundary layer pump in downhole pumping applications of multiphase fluids, and despite considerable development work of boundary layer pumps over the last century since inception by Tesla, it has never been found possible to provide downhole pumps based on boundary layer principals.

The inventors teach herein a novel pump design which may be utilized as a downhole pump that provides the advantages of a boundary layer pump better suited to handling multiphase fluids with solids, liquids, and gases which are typical of oil and gas wells as compared with presently existing downhole pumps based on traditional pump designs. The novel pump may comprise an axial discharge that may efficiently utilize a straight tubular pump housing whereby fluid is moved through the tubular housing. Moreover, the inventors have determined that it may be desirable that the novel pump design of the present invention permit axial interconnection of any number of identical or substantially identical axial flow pump stages to thereby increase the pumping head as desired while keeping the flow rate constant, as is also highly advantageous for wellbore pumping applications where the fluid must be pumped to the surface from significant depths. Prior art bladeless or boundary layer machines simply do not provide any solution to these pumping goals. Existing downhole pumps are subject to the disadvantages of traditional pumps discussed above.

Discflo Corporation at www.discflo.com discloses the use of parallel disk boundary layer pumps. The Discflo pumps appear similar to those of Tesla and are advertised for use in solving tough pumping problems. The Discflo pumps may be used for pumping fluids which may contain abrasive fluids which may comprise sand, fly ash, and even rocks. The Discflo pumps are also useful for pumping high viscosity fluids such as crude oil, sludge, multiphase petroleum products, chemicals and the like. The Discflo website also shows use of a particular Discflo pump which is said to utilize two conical ribbed disks in parallel that rotate perpendicular to the pump inlet and which produces a radial flow fluid outlet with fluid perpendicular to the pump inlet. The founder of Discflo, believed to be Max Gurth, is listed as the inventor of several patents related to boundary layer pumps, stirring machines, and the like.

U.S. Pat. No. 4,416,582, issued to Glass et al on Nov. 22, 1983, entitled "Multi-Stage Turbine Rotor", discloses a multi-stage turbine that has an inflow disc pack that directs motivating fluid to an outflow disc pack on the same shaft. The packs are fitted to rotate between plates that web a turbine casing interior and fluid entry into the casing to the inflow pack is via nozzles in a ring assembly fixed to the casing. Each disc pack is made up by spaced apart discs with fences that guide the motivating fluid first through the inflow pack and then the outflow pack. A central passageway in the packs and adjacent the shaft communicates fluid inflow to outflow. Fluid exhaust is through exits at the casing bottom. In one version, the disc packs are conical and when seen from the side, the packs with webbed plates are X configured in section. In another version, the inflow pack is flat, the outflow pack conical and the casing of both versions are configured to provide low losses and maximum strength. The nozzles can be convergent-divergent in a plenum located adjacent the inflow pack circumference.

U.S. Pat. No. 4,586,871, issued to Glass on May 6, 1986, entitled "Shaftless Turbine", discloses a turbine that has a disc pack rotor with a central aperture-free or solid disc that divides the pack into two equal portions. The annular discs of each portion have aligned, central and unobstructed exhaust openings and the outer end disc of each portion is a support member having a webbed hub that is attached to a respective drive shaft journaled in the turbine casing. A stationary circular nozzle assembly closely surrounds the outer circumference of the disc pack to form one or more convergent-divergent nozzles that guide motivating fluid from an outer casing plenum into spaces between neighboring discs. The discs are separated from one another and interconnected by fences that guide the motivating fluid to the exhaust openings in each pack portion. Thus, fluid enters the pack circumference and is split into two parts by the center disc to exhaust in relatively opposite directions. The shaft for each pack portion preferably terminates at the outer support disc to form a two-direction "shaftless"rotor.

U.S. Pat. No. 4,036,584, issued to Glass on Jul. 19, 1977, entitled "Turbine", discloses an invention that relates to turbines wherein fluid pressure temperature energy is released, via its passage from a high-speed nozzle delivery mounted externally and tangentially, to closely-spaced together circular profiled sheet metal, or ceramic, plates, preferably plate members that have concave and convex surfaces, at least in part, which form high surface area bodies of revolution. An assembly of disc members form the turbine rotor within which the surface adhesion effect of the traversing fluid imparts rotation to the rotor before it is finally expelled through an exhaust duct formed by centrally disposed exits in the assembly. A spiral-like fence baffle on the rear face of the plates tie adjoining surfaces together and provide expanding fluid flow channels between adjacent plates.

U.S. Patent Publication No. 2004/0136846, by Morteza Gharib, published on Jul. 15, 2004, entitled "Bladeless Pump", discloses a pump which is bladeless, and uses a substantially cylindrical outer cylinder to rotate inside a ridged inner chamber.

U.S. Patent Publication No. 2002/0119040, by Robert W. Bosley, published on Aug. 29, 2002, entitled "Crossing Spiral Compressor/Pump", discloses a crossing spiral compressor or pump having a cylindrical rotor rotating within a cylindrical stator bore. Both the outer surface of the rotor and the bore of the stator include a plurality of spiral fluid flow channels separated by narrow blades, with the spiral fluid flow channels of the stator bore spiraling in the reverse or opposite direction relative to the spiral fluid flow channels of the rotor. The fluid flow channels on the rotor and in the bore have open sides that face the annular gap between the rotor and stator with the channels crossing each other at many locations to facilitate fluid exchange between rotor channels and bore channels.

U.S. Pat. No. 6,798,080, issued to Baarman et al, on Sep. 28, 2004, entitled "Hydro-Power Generation for a Water Treatment System and Method of Supplying Electricity Using a Flow of Liquid", discloses a hydro-power generation system for use in conjunction with a water treatment system. The embodiments of the hydro-power generation system include an impeller rotatably positioned in a housing. The impeller is rotatably coupled with a generator. When water flows through the water treatment system, water flows to the hydro-power generation system and acts on the impeller causing rotation thereof. The rotation of the impeller results in the generation of electricity for the water treatment system by the generator. Other embodiments of the hydro-power generation system include a rotor rotatably positioned in a conduit through which water flows. The flowing water causes the rotor to rotate. The rotor operatively cooperates with a surrounding stator. As the rotor rotates within the stator electricity is generated for the water treatment system.

U.S. Pat. No. 6,752,597, issued to Pacello et al, on Jun. 22, 2004, entitled "Duplex Shear Force Rotor", discloses a single or multi-stage centrifugal pump or mixer duplex shear force rotor. The rotor is circular and consists of two non-parallel shrouds with inner, opposing faces. The driven shroud contains a center opening. The rotor has an open, unobstructed entrance section with no raised ribs and includes a protrusion designed to force-feed the discharge section in a smooth laminar flow pattern. The discharge section incorporates a series of raised ribs. The raised ribs begin at the peripheral edge of the drive and driven shrouds and extend in a direction towards the center of the drive and driven shroud and terminate approximately 50% of the distance from the periphery and the center of the rotor. Cast-in-place spacers space the drive and driven shrouds. Alternatively, the rotor can include no raised ribs. In addition, the raised ribs can have a cross-section that includes a tapered trailing edge to reduce wear. The rotor can also be used without inclusion of the raised ribs. Alternatively, neither the drive or driven shroud are perpendicular to the axis of rotation.

U.S. Pat. No. 6,726,443, issued to Collins et al, on Apr. 27, 2004, entitled "Micromachines", discloses a micromachine including at least one bladeless rotor, said rotor being adapted to impart energy to device energy to or derive energy from a fluid. A rotor for a micromachine comprising at least a pair of closely spaced co-axially aligned discs defining opposed planar surfaces, at least one disc having at least one aperture whereby a fluid passageway is defined between the aperture, the planar surfaces and the periphery of the rotor, the rotor being formed of a single crystal material.

U.S. Pat. No. 6,726,442, issued to Letourneau, on Apr. 27, 2004, entitled "Disc Turbine Inlet to Assist Self-Starting", discloses a disc turbine inlet that collects working fluid, introduces it into the rotor housing at a defined location and imparted at a defined injection angle with respect to the tangential motion of the discs in rotary motion. An injection angle within the optimum range delineated by this invention enables the working fluid to entrain stationary or slowly rotating discs into motion. The inlet design combines smooth sectional transitions and arcuate directional changes to minimize frictional losses. The inlet has a nozzle section which locates precisely into a receiving aperture of the turbine rotor housing.

U.S. Pat. No. 6,692,232, issued to Letourneau on Feb. 17, 2004, entitled "Rotor Assembly for Disc Turbine", discloses a disc turbine rotor assembly comprised of spaced-apart discs, which includes means of spacing apart disc members of said rotor assembly, which allow for local variation and radial expansion under various local operating temperatures, without allowing axial deflection, deformation, or excessive warping of the disc material. Spacing means and positioning are provided which maintain desired gaps between planar disc surfaces, and may also establish tangential waves in the disc membranes in order to enhance boundary layer effects. Disc and spacer spokes combine to form a vane-axial type exhaust.

U.S. Pat. No. 6,682,077, issued to Letourneau on Jan. 27, 2004, entitled "Labyrinth Seal for Disc Turbine", discloses a disc turbine that has a rotor assembly of spaced apart discs with at least one disc equipped with an annular labyrinth seal whose grooves interdigitate with a corresponding labyrinth seal mounted in the sidewall of the rotor housing. A pattern of aligned through holes in the rotor housing and the rotor housing seal assist in the axial and concentric alignment of the rotary assembly with respect to the stationary assembly, and the inspection of same, and provide access through at least one sensing port to working fluid proximal to the seal entrance.

U.S. Pat. No. 6,595,762, issued to Khanwilkar et al on Jul. 22, 2003, entitled "Hybrid Magnetically Suspended and Rotated Centrifugal Pumping Apparatus and Method", discloses an apparatus and method for a centrifugal fluid pump for pumping sensitive biological fluids, which includes (i) an integral impeller and rotor which is entirely supported by an integral combination of permanent magnets and electromagnetic bearings and rotated by an integral motor, (ii) a pump housing and arcuate passages for fluid flow and containment, (iii) a brushless driving motor embedded and integral with the pump housing, (iv) a power supply, and (v) specific electronic sensing of impeller position, velocity or acceleration using a self-sensing method and physiological control algorithm for motor speed and pump performance based upon input from the electromagnetic bearing currents and motor back emf—all fitly joined together to provide efficient, durable and low maintenance pump operation. A specially designed impeller and pump housing provide the mechanism for transport and delivery of fluid through the pump to a pump output port with reduced fluid turbulence.

U.S. Pat. No. 6,582,208, issued to Gharib on Jun. 24, 2003, entitled "Bladeless Pump", discloses a bladeless pump that is made with rotating parts that are substantially flexible, allowing them to be assembled into desired shapes. The rotating part preferably has no blades thereon, and rotates to produce a fluid flow inside a chamber. The fluid flow in the chamber causes flow along the chamber axis, which itself may be bent.

U.S. Pat. No. 6,503,067, issued to Palumbo on Jan. 7, 2003, entitled "Bladeless Turbocharger", discloses a bladeless turbocharger for use with an internal combustion engine. The apparatus includes a drive shaft engaged with a bearing assembly that has a turbine driven by the exhaust gas from the internal combustion engine at one end and a blower driven by the turbine at the other. The turbine and blower have flat disks spaced at a critical distance apart with open circular centers that have spokes mounting them to the drive shaft. The critical distance between the turbine disks promotes the boundary layer drag effect of the exhaust gas against the turbine disks. The blower transfers rotational energy to air entering the critical distance between the blower disks by boundary layer drag effect of the air against the blower disks only. The energy transfer increases the mass per unit volume of the air that exits the blower through a blower outlet.

U.S. Pat. No. 6,368,078, issued to Palumbo on Apr. 9, 2002, entitled "Bladeless Turbocharger", discloses a bladeless turbocharger for use with an internal combustion engine. The apparatus includes a drive shaft engaged with a bearing assembly that has a turbine driven by the exhaust gas from the internal combustion engine at one end and a blower driven by the turbine at the other. The turbine and blower have flat disks spaced at a critical distance apart with open circular centers that have spokes mounting them to the drive shaft. The critical distance between the turbine disks promotes the boundary layer drag effect of the exhaust gas against the turbine disks. The blower transfers rotational energy to air entering the critical distance between the blower disks by boundary layer drag effect of the air against the blower disks only. The energy transfer increases the mass per unit volume of the air that exits the blower through a blower outlet.

U.S. Pat. No. 6,354,318, issued to Butler on Mar. 12, 2002, entitled "System and Method for Handling Multiphase Flow", discloses a method and device for transferring a multiphase flow to a predetermined location through a pipe. The multiphase flow is comprised of at least a liquid phase and a gas phase. The multiphase flow is provided to a flow divider that diverts a gas portion from the multiphase flow. A compressor and a pump are in fluid communication with the flow divider. The main gas portion is boosted by the compressor, and the residual liquid/gas portion is boosted by the pump. A recombination manifold then recombines the gas portion and the residual liquid portion. A single pipe receives the recombined multiphase flow and transfers it to a predetermined location.

U.S. Pat. No. 6,224,325, issued to Conrad et al on May 1, 2001, entitled "Prandtl Layer Turbine", discloses an apparatus that comprises a longitudinally extending housing having a fluid inlet port and a fluid outlet port; a plurality of spaced apart members rotatably mounted in the housing to transmit motive force between fluid introduced through the fluid inlet port and the members; each member having a pair of smooth opposed surfaces, each surface having an inner portion and an outer portion; and, at least one of the members having a width that is increased at at least one discrete location to alter the fluid flow over the surface of that member.

U.S. Pat. No. 5,518,363, issued to Theis on May 21, 1996, entitled "Rotary Turbine", discloses a rotary turbine that includes a source of a pressurized medium and a rotor assembly. In one embodiment, the rotor assembly includes first and second rotors, and the surface of each rotor is substantially smooth. The pressurized medium flows between the rotors, turning the rotors. The smooth rotor surfaces do not cause substantial turbulence in the medium. Accordingly, the exit velocity of the pressurized medium is maintained at a substantial higher level than if the rotors included blades or other protrusions extending outwardly.

U.S. Pat. No. 5,470,197, issued to Cafarelli on Nov. 28, 1995, entitled "Turbine Pump with Boundary Layer Blade Inserts", discloses a self-adjusting blade insert used for improving the efficiency of low rotating disc pumps by use of pivotal disc inserts disposed between the rotating discs of a multi-disc pump turbine style pump causing a positive displacement of fluid during the low rotating conditions or low viscosity fluid environment. The blade inserts of the instant invention include a biasing spring which allows the blade inserts to pivot outward when sufficient hydraulic pressure creates force against a lower surface of the blade inserts allowing maximum flow at higher rotations or predetermined operating conditions.

U.S. Pat. No. 5,406,796, issued to Hiereth et al on Apr. 18, 1995, entitled "Exhaust Gas Turbocharger for a Supercharged Internal Combustion Engine", discloses an exhaust gas turbocharger for a supercharged internal combustion engine, in which the exhaust gas turbocharger includes at least one turbine and at least one compressor and the turbine has a turbine casing with a spiral-shaped flow guide duct, a turbine wheel, an inlet end and an outlet end and the compressor includes a compressor casing with a diffuser duct, an impeller, a pressure side and a suction side and the turbine wheel and the compressor impeller are mounted on a common shaft and the turbine casing and the compressor casing, together with a bearing housing, an exhaust gas turbocharger casing and define a gas conduit connection between the inlet end of the turbine and the pressure side of the compressor with at least one control valve and a gas delivery device arranged in the gas conduit connection for controlling the flow of gas between the inlet end of the turbine and the pressure side of the compressor.

U.S. Pat. No. 5,388,958, issued to Dinh on Feb. 14, 1995, entitled "Bladeless Impeller and Impeller Having Internal Heat Transfer Mechanism", discloses an impeller that displaces fluids without turbulence, thereby reducing noise and increasing efficiency. The impeller employs annular disks stacked on a shaft which may be rotatably mounted in a specially shaped housing. The disks cooperate with a complementary surface formed, e.g., by the interior of the impeller housing or by another impeller, so as to use a combination of surface friction, centrifugal forces, and a venturi effect to propel fluids tangentially without turbulence. The impeller is well suited for use with a heat exchange device because the flat disks present a large surface area providing good heat exchange with fluids flowing past the disks. A heat pipe or other suitable heat transfer mechanism may be provided in the shaft of the impeller to form a heat transfer system integral with the impeller for heating or cooling purposes.

U.S. Pat. No. 5,363,653, issued to Zimmermann et al on Nov. 15, 1994, entitled "Cylindrical Combustion Chamber Housing of a Gas Turbine", discloses a cylindrical combustion chamber housing of a gas turbine, in which the compressor air is fed into the lower, conical part of the combustion chamber housing, the perforated cone, through a lateral, arc-shaped inlet elbow. The inlet elbow is directly joined by the intake distribution element, in which the compressor air is led around the perforated cone on both sides. The tangential flow is converted around a cone into an axial flow through the holes in the perforated cone. The conversion of the direction of flow of the compressor air is supported by radially arranged ribs. As a result, optimal cooling of the entire injector tube is achieved, while the pressure drop in the air feed area is minimized, and the efficiency of the gas turbine is increased at the same time.

U.S. Pat. No. 4,652,207, issued to Brown et al on Mar. 24, 1987, entitled "Vaneless Centrifugal Pump", discloses a centrifugal pump utilizing laminar action induced by a vaneless impeller and having a minimal drag front plate which cooperates with the circular rotor. The smooth surface of the concave face of the circular rotor has no protrusions or vanes and approximates an Archimedian curve. Material entering the intake port of the front plate is diverted about the rotating circular rotor and redirected in an outwardly direction along the minimal drag interior surface of the front plate to the discharge port of the output housing. The narrowing of the interior surface of the front plate in a radially outward direction with respect to the concave face of the impeller helps the pump to maintain a constant volumetric flow rate. Inasmuch as the "redirecting" of the incoming material stream follows an approximate Archimedian spiral, the pressures applied against the impeller and the forces acting centrifugally on the material stream join to produce the optimum imparting of kinetic energy to the material stream for the particular impeller speed. As a slurries pump, the vaneless design permits any particulate size that can clear the discharge port of the pump to safely transit through the pump without maceration or undue agitation. As cavitation is totally absent, the pump can easily handle the movement of fragile, volatile or gaseous materials and can be operated over a wide range of speeds, matching desired feed without undue loss of efficiency. Lacking vanes, the impeller offers very low starting torque under a loaded condition.

U.S. Pat. No. 4,417,877, issued to Krautkremer et al on Nov. 29, 1983, entitled "Water-Jet Drive Mechanism for Driving and Controlling of Particularly Shallow-Draught Watercrafts", discloses a water-jet drive mechanism for driving and controlling a watercraft. A centrifugal water pump is encased in the support housing so that its inlet and its discharge nozzle open through the undersurface of the support housing. The pump drive shaft is inclined and lies in a vertical plane arranged at an angle to the direction of water discharge from the nozzle. A normally open ventilating valve provided in a wall of the pump is closed by the flow of water through the pump.

U.S. Pat. No. 4,403,911, issued to Possell on Sep. 13, 1983, entitled "Bladeless Pump and Method of Using Same", discloses a bladeless pump that includes a housing that defines a circular confined space of substantial width into which either a single phase fluid or multiphase fluid is sequentially introduced through a centrally disposed inlet in a first side of the housing to be subjected to boundary layer rotational drag by at least one substantially smooth disc that rotates in the confined space intermediate the first and second side pieces of the housing and parallel thereto. The pump is capable of pumping a multiphase fluid such as that from a geothermal well that includes water, dissolved solids, steam and gas vapor, or a fluid in which the outer phase is water and the inner phase may range through such diverse materials as particled coal, marine animals such as fish, shrimp and crustaceans, and edibles that include fruits, vegetables and berries, as well as metallic objects of which steel ball bearings is an example. The pump has the capability of pumping beer without appreciably frothing the latter. Also, the pump is particularly adapted for pumping a multiphase liquid in which the inner phase is extremely frangible, of which blood is an important example. The boundary layers on the rotating discs prevent objects in the inner phase of a fluid contacting the discs and as a result there is little or no abrasion of the latter. Also, the boundary layers on the discs protect the latter from contact with bubbles in the fluid, and as a result there is no cavitation on the discs due to abrupt collapse of the bubbles.

U.S. Pat. No. 4,378,703, issued to Furness et al on Apr. 5, 1983, entitled "Flowmeter", disclosing a flow meter of the type comprising a rotor consisting of a spindle and bearing heads cooperating with seats to give support of the rotor, it has been found that the flow does not split evenly between the ends. In order to improve the flow performance, the flow characteristics of the two heads are chosen to be different so as to have their transitions from laminar to turbulent flow occurring sequentially. It is preferred that the turbine means on the rotor be formed by angled passages through the bearing heads.

U.S. Pat. No. 4,372,731, issued to Fonda-Bonardi on Feb. 8, 1983, entitled "Fluid Flow Control System", discloses a fluid flow control system for use with turbines, such as the Tesla-type turbine, where the power fluid contains large amounts of impurities and where it is desired to closely modulate the flow of the fluid to the turbine. The fluid flow channels to the turbine wheel are defined by a plurality of cooperating fluid flow confining blades which may be adjusted to controllably vary the cross-sectional area of the fluid flow channels. The convergent inlet portions and substantially parallel outlet portions of the fluid flow channels as defined by the blades provide a geometry which is highly conducive to the dampening of upstream turbulence and to the injection toward the turbine wheel of an essentially laminar jet. The configuration of the blades and the manner of their adjustment is such that the angular convergence of the inlet portions and the parallelism of the outlet portions of the channels does not change as the blades are adjusted to vary the cross-sectional area of the channels.

U.S. Pat. No. 4,280,791, issued to Gawne on Jul. 28, 1981, entitled "Bi-Directional Pump-Turbine", discloses an improved fluid propulsion apparatus of the type which includes a housing, a plurality of spaced apart discs rotatably mounted on a shaft and positioned within the housing, and a plurality of fluid inlet and outlet ports all in communication with the interior of the housing. The housing includes a circumferential peripheral zone defined as the region between the interior of the housing and the periphery of the discs. The apparatus may be utilized as a pump or as a turbine. During operation as a pump, the shaft and discs are rotated and fluid is introduced into the housing at a port at the center of the housing, flows in an outwardly spiraling path between the discs within the housing, and flows into the peripheral zone from where it is removed through one of several ports at the periphery of the housing. The ports at the periphery of the housing are positioned such that the apparatus may be utilized as a pump with the discs and shaft rotated in either a clockwise or a counter-clockwise direction. When the apparatus is utilized as a turbine, fluid is injected into the peripheral zone through a port at the periphery of the housing and flows in an inwardly spiraling path thus causing rotation of the discs and shaft, and the fluid then exits the housing from a port adjacent the shaft. Again, the positional relationship of the ports at the periphery of the housing permits the injection of the fluid to rotate the discs and shaft in either the clockwise or counter-clockwise direction. The ports at the periphery of the housing may be pitot-like flow paths bored in a pitot block which is removably secured to the housing to provide versatility of fluid flow characteristics.

U.S. Pat. No. 4,239,453, issued to Hergt et al on Dec. 16, 1980, entitled "Means for Reducing Cavitation-Induced Erosion of Centrifugal Pumps", discloses that erosion of parts owing to cavitation in the part-load region of operation of a centrifugal pump is reduced or eliminated by equipping the pump with an annular diffuser which is installed upstream of the annular intake of the impeller. The impeller portion immediately downstream of the inlet edge, where the vanes begin, is bounded by a surface which diverges at an angle of 8 to 20 degrees, as considered in the direction of fluid flow in the impeller. The diffuser has a smaller first cross section which is remote from and a larger second cross section which is nearer to the impeller. The area of the smaller cross section is between one-half and nine-tenths of the area of the larger cross section. If the diffuser has a conical internal surface, the angle of divergence of such conical surface (as considered in the direction of fluid flow toward the impeller) is between 5 and 15 degrees. If the diffuser is internally stepped, the ratio of its length to the diameter of the larger cross section is between 0.2 to one and one to one.

U.S. Pat. No. 4,232,992, issued to Possell on Nov. 11, 1980, entitled "Geothermal Turbine and Method of Using the Same", discloses a turbine and method of using the same to generate rotational power from a desired geothermal source from which a multi-phase pressurized and heated fluid is discharged, which fluid contains steam and particles of water, and may contain particles of solid material. The turbine includes a rotor plate with a number of spaced discs secured to opposite sides thereof that are rotatably supported in a housing, and the housing having two laterally spaced sets of circumferentially disposed nozzle bodies situated therein that are each adjustable to define a convergent section, a throat and a diverging section. The nozzle bodies are so adjustable that streams of fluid at maximum velocity for a multi-phase fluid having particular characteristics as to heat, pressure and water droplet content discharge tangentially onto the two sets of spaced discs to flow through the spaces therebetween in spiral paths to discharge through openings in the centers thereof. The fluid as it pursues a spiral path exerts a drag on the discs, with the fluid losing kinetic energy that is transferred to the discs, rotor plate and shaft to drive them as an integral unit. No substantial lateral force is exerted on seals in the turbine as the lateral force generated by one set of discs by pressurized fluid flowing through the spaces therebetween is cancelled out by a like and opposite force generated on the other set of discs by the fluid.

U.S. Pat. No. 4,218,176, issued to Gawne on Aug. 19, 1980, entitled "Fluid Propulsion Apparatus", discloses an improved fluid propulsion apparatus of the type including a housing and a plurality of spaced apart discs rotatably mounted on a shaft and positioned within the housing. The housing includes a circumferential peripheral zone, defined as the region between the interior of the housing and the periphery of the discs, and further includes inlet and outlet ports each in communication with the interior of the housing. The apparatus may be utilized as a liquid pump, liquid ring pump, vacuum pump, air compressor or blower, mixer or blender, and as a turbine. During operation as a pump, the shaft and discs are rotated within the housing and fluid enters the port at a center port of the housing, flows in an outwardly spiraling path between the discs within the housing, and continues to flow into the peripheral zone from which it is removed through a port or ports at the periphery of the housing, such as through a pitot-like fluid flow path. When the apparatus is used as a turbine, fluid, air or steam is injected into the peripheral zone through pitot-like flow paths, flows in an inwardly spiraling path, thus causing rotation of the discs and shaft, and the fluid then exits the housing from the central port. The pitot-like flow paths have a cross-sectional area which does not exceed about 60 percent of the corresponding cross-sectional area of the peripheral zone. In one embodiment the pitot-like flow paths are bored in a pitot block which in turn is removably secured to the housing. The removable pitot block offers the versatility of changeable head (pressure) and flow characteristics.

U.S. Pat. No. 3,738,773, issued to Tinker on Jun. 12, 1973, entitled "Bladeless Pump Impeller", discloses a bladeless pump impeller having a hollow, generally tubular body with an inlet end and an outlet end communicating with the hollow interior. The inlet to the impeller is of generally circular cross-section and the outlet is of generally oblong cross-section, the interior wall of the impeller providing a smooth transition from the inlet to the outlet.

U.S. Pat. No. 3,478,691, issued to Henry on Nov. 18, 1969, entitled "Quiet Multivane Multirow Impeller for Centrifugal Pumps", discloses a multivane impeller for centrifugal pumps having a plurality of axially spaced rows of vanes separated by disc-shaped members thereby defining radially extending fluid passages. The equi-angularly spaced peripheral output ports of the fluid passages in one axial row are angularly spaced in relation to the ports of the next adjacent axially spaced row thereby reducing pressure pulsations on the pump output pressure and therefore reduce fluid-borne and structure-borne noise.

U.S. Pat. No. 3,392,675, issued to Taylor on Jul. 16, 1968, entitled "Centrifugal Pump", discloses a centrifugal type air pump having a toroidal air flow passage split along a plane normal to the axis of rotation, one-half containing blades and being rotatable, the other half being stationary and bladeless but containing a block seal that is slightly wider circumferentially than the space between rotor blades and separates the inlet and outlet passages as well as seals the space between rotor blades as they pass over the seal face, the air discharge outlets comprising a plurality of circumferentially spaced openings in different pressure zones of the pump all connected at all times to a common outlet manifold and each gradually increasing in cross-sectional area in a downstream or outlet direction.

U.S. Pat. No. 3,356,033, issued to Ullery on Dec. 5, 1967, entitled "Centrifugal Fluid Pump", discloses a centrifugal pump having a toroidal shaped cavity that is split in two along a plane normal to the axis of rotation. One-half of the torus contains a bladed rotor, the other half being bladeless, but containing a block seal or abutment with a fluid inlet and outlet to the torus chamber located on opposite sides of the abutment. The abutment in general is wider circumferentially than the space between two adjacent rotor blades, to seal and trap fluid in the space as the blades pass over the abutment. However, a portion of the outer part of the abutment is cut away and angled towards the inlet to direct a portion of the trapped fluid toward the inlet in a manner to impart energy to it.

U.S. Pat. No. 3,228, 344, issued to Cooper on Jan. 11, 1966, entitled "Centrifugal Impeller and Method of Making Same", discloses turbo machines and more particularly relates to a centrifugal impeller which is characterized by a spiral vane system wherein the vanes are interrupted by slotted passageways through which jets of liquid from the high pressure side of the vanes is directed to the low pressure sides of the adjacent passages to accelerate and mix gas and liquid so the mixture can be effectively pumped.

U.S. Pat. No. 3,212,265, issued to Heinz-Dieter Neuber on Oct. 19, 1965, entitled "Single Stage Hydraulic Torque Converter with High Stall Torque Ratio and Utility Ratio", discloses a single stage hydraulic torque converter with a high stall torque ratio and utility ratio.

U.S. Pat. No. 2,655,868, issued to Lindau et al on Oct. 20, 1953, entitled "Bladeless Pump Impeller", discloses impellers for centrifugal pumps, and has particular reference to a centrifugal pump impeller of a novel bladeless, non-clogging character, suitable especially for use in pumping fluids such as sewage, containing stringy, pulpy and solid matter.

The presently improved impeller, however, is not limited to sewage pumps, as it may be readily embodied in centrifugal pumps having wide utility in the pumping of fluids generally.

U.S. Pat. No. 2,609,141, issued to Aue on Sep. 2, 1952, entitled "Centrifugal Compressor", discloses a centrifugal compressor with an approximately conical rotor for producing a high stage pressure ratio combined with a plurality of diffusors arranged in an axial direction from that rotor. The invention consists in combining rotor blades having a radial projection in sections taken at right angles to the rotor axis in order to avoid bending stresses, but also shaped to send the medium flowing from the rotor in a direction oblique to the rotor axis with an intermediate member provided with directing channels for first deviating that medium at approximately unchanged velocity into a direction at least approximately parallel to the rotor axis and leading to diffusers having generally straight axes in which that medium is then slowed down.

U.S. Pat. No. 2,271,919, issued to Jandasek on Feb. 3, 1942, entitled "Turbine Torque Converter", discloses means for transmitting power, and more particularly to a fluid transmission of the type having rotary driving or impeller means to impart energy to a fluid and driven or turbine runner means to absorb energy from the energized fluid. The invention is further characterized by the fact that vanes, stationary gates, or a guide wheel is interposed between the exit from the driven means and the entrance to the driving means.

U.S. Pat. No. 2,222,618, issued to Jandasek on Nov. 26, 1940, entitled "Turbine Torque Converter Combined with Turbine Clutch", discloses a rotary apparatus for the transmission of power of the type comprising a passage for fluid including a pump impeller, a turbine runner and a stationary guide wheel.

U.S. Pat. No. 2,087,834, issued to Brown et al on Jul. 20, 1937, entitled "Fluid Impeller and Turbine", discloses improvements in fluid impellers and turbines. While the device herein disclosed is described primarily as a fluid impeller for the purposes of the present invention, its moving part nevertheless has utility also as the runner or rotor of a fluid turbine or motor.

U.S. Pat. No. 1,989,966, issued to Biggs on Feb. 5, 1935, entitled "Hydraulic Turbine", discloses a hydraulic turbine that can be adapted to high or medium specific speed characteristics by selecting suitable runner vane angles, as well as a turbine of less weight for a given amount of power or head without sacrifice of strength.

U.S. Pat. No. 1,865,503, issued to Biggs on Jul. 5, 1932, entitled "Hydraulic Turbine", discloses a hydraulic turbine that can be adapted to high or medium specific speed characteristics by selecting suitable runner vane angles, as well as a turbine of less weight for a given amount of power or head without sacrifice of strength.

U.S. Pat. No. 1,061,206, issued to Tesla on May 6, 1913, entitled "Turbine", discloses certain new and useful improvements in rotary engines and turbines.

U.S. Pat. No. 1,061,142, issued to Tesla on May 6, 1913, entitled "Fluid Propulsion", discloses certain new and useful improvements in fluid propulsion.

U.S. Pat. No. 1,056,338, issued to Johnsen on Mar. 18, 1913, entitled "Friction Turbine", discloses certain new and useful improvements in friction turbines.

U.S. Pat. No. 651,400, issued to Trouve et al on Jun. 12, 1900, entitled "Rotary Pump", which relates to rotary pumps, and said invention is substantially characterized by two cones arranged one inside the other and connected by ribs, so as to leave a space between them to permit the liquid sucked up by the rotary motion of both cones to pass into a casing of the same form, which rotary motion is produced by the action of a shaft passing through the device and to which motion is transmitted in any suitable manner.

Great Britain Patent No. 578,115, issued to Baumann et al on Jun. 17, 1946, entitled "Improvements in Turbines and the Like."

Great Britain Patent No. 381,193, issued to Seaton-Snowdon on Oct. 3, 1932, entitled "Improvements in Internal Combustion Turbines."

European Patent No. 0 846 844 B1, issued to Meylan on Feb. 26, 2003, entitled "Rotor assembly with rotor discs connected by both non-positive interlocking and interpenetrating or positive interlocking means."

European Patent No. 0 607 320 B1, issued to Kletschka on Oct. 1, 2001, entitled "Fluid Pump with Magnetically Levitated Impeller."

European Patent No. 0 002 592 A1, issued to Possell on Jun. 27, 1979, entitled "Bladeless Pump and Method of Using Same."

WIPO International Publication No. WO 2004/008829 A2, published on Jan. 29, 2004, by Hunt, entitled "Turbines Utilizing Jet Propulsion for Rotation."

WIPO International Publication No. WO 01/42653 A1, published on Jun. 14, 2001, by Bearnson et al, entitled "Electromagnetically Suspended and Rotated Centrifugal Pumping Apparatus and Method."

WIPO International Publication No. WO 00/79129 A1, published on Dec. 28, 2000, by Gharib, entitled "Bladeless Pump."

WIPO International Publication No. WO 99/36687, published on Jul. 22, 1999, by Murphy et al, entitled "An Improved Apparatus for Power and Clean Water Production."

The above cited art does not overcome the problems and/or appreciate the advantages discussed hereinbefore. Consequently, there is a need for a bladeless or boundary layer turbine pump that produces axial discharge from the pump housing and which may be connected together with multiple identical stages for increased pumping capability. Those of skill in the art will appreciate the present invention, which addresses the above problems and provides solutions which are discussed hereinafter.

SUMMARY OF THE INVENTION

One objective of the present invention is to provide improved bladeless turbo-machinery.

Another objective of a possible embodiment of the present invention is to direct fluid through a pump housing and into additional stages in a manner that changes the velocity and direction of movement of the fluid as gradually as possible to thereby increase the efficiency of operation.

Yet another objective of one possible embodiment of the present invention is to provide a boundary layer inline discharge suction-coupled pump.

One advantage of one possible embodiment of the present invention is the ability to provide a relatively small diameter downhole submersible pump for use in oil wells pumping multiphase fluids which may be driven at high rotational speeds as compared to existing downhole submersible pumps.

Another advantage of one possible embodiment of the present invention is the ability to provide identical or substantially identical axial pump stages which may be stacked together axially to increase the pump head to a desired amount for a desired fluid flow capability.

One feature of one possible embodiment of the present invention are generally conical or dome-shaped rotor elements which may be venturi-shaped, convex, concave, dish-shaped, and/or which provide a smooth surface for operation utilization as a boundary layer turbine.

These and other objectives, features, and advantages of the present invention will become apparent from the drawings, the descriptions given herein, and the appended claims. However, it will be understood that above-listed objectives of the invention and the brief description hereinafter are intended only as an aid in quickly understanding certain aspects of the invention, is not intended to limit the invention in any way, and therefore does not form a comprehensive or restrictive list of objectives, and/or features, and/or advantages. Moreover, the scope of this patent is not intended to be limited to its literal terms but instead embraces all equivalents to the claims described.

Accordingly, the present invention provides a rotary machine operable for transformation of energy between rotary mechanical energy and fluid kinetic energy which may comprise one or more elements such as, for instance, a tubular housing defining a fluid input and a fluid output and a rotor operating region and a rotor mounted within the rotor operating region for rotation about a rotor axis of rotation. The rotor may comprise a first rotor end and a second rotor end with the axis of rotation extending between the first rotor end and the second rotor end. The rotor operating region may be positioned between the fluid input and the fluid output such that first rotor end is positioned adjacent to the fluid input and the second rotor end is adjacent to the fluid output. A plurality of rotor elements may be axially spaced from each other along the rotor. The plurality of rotor elements may in one preferred embodiment comprise a plurality of conical surfaces or domed surfaces oriented on the rotor so as to be concentric to the rotor axis of rotation. The plurality of rotor elements define therebetween a plurality of radial flow paths.

In one possible embodiment, the plurality of radial flow paths are oriented parallel or substantially parallel with respect to each other. The plurality of rotor elements may comprise relatively smooth radially symmetrical surfaces without blades. In one embodiment, at least a portion the plurality of rotor elements are substantially identical.

The fluid input may be provided on an opposite end of the tubular housing from the fluid output and/or the rotary machine may further comprise a straight drive shaft which extends through the fluid input and the fluid output. The tubular housing may have a straight tubular axis about which the tubular housing is concentric and the straight tubular axis and the straight drive shaft may be coaxial with respect to each other.

The rotary machine may further comprise one or more peripheral fluid flow paths along a periphery of the rotor. The peripheral fluid flow path may be in communication with the fluid input and the fluid output. The tubular housing may constrain fluid to move in a generally axial direction through the fluid input into the tubular housing, through the peripheral flow path, and out of the tubular housing through the fluid output. The peripheral flow path may be substantially concentric with the rotor.

The rotary machine may further comprise a substantially cylindrical interior wall around the rotor wherein the interior wall defines at least a portion of one or more helical or spiraling channels and the one or more helical or spiral channels may define at least a portion of the peripheral flow path. In one embodiment, the spiraling flow paths each comprise a helical flow path with turns of constant slope and constant distance from the rotor axis of rotation.

The rotary machine may further comprise a radial bearing for the rotor and the radial bearing may comprise one or more flow paths therethrough.

In another embodiment, the rotary machine may comprise a plurality of tubular housing sections each section defining a fluid input and a fluid output and a rotor operating region such that the plurality of tubular housing sections may be axially connected or continuous with respect to each other. A respective output of each tubular section may be connected to a respective input of another tubular section. The rotary machine may further comprise a drive shaft extending through the plurality of tubular housing sections. The rotary machine may further comprise at least one radial bearing for each respective one of the plurality of rotors and the radial bearing may comprise one or more flow paths therethrough. The rotary machine may comprise a plurality of fluid transition sections between each of the plurality of rotors and the fluid transition sections may define interior sloping tubular walls.

The present invention may comprise a method for making a rotary machine for transformation of energy between rotary mechanical energy and fluid kinetic energy. The method may comprise one or more steps such as mounting a plurality of rotor elements onto a rotor wherein the plurality of rotor elements may be axially spaced from each along the rotor and the plurality of rotor elements may comprise a conical surface or domed surface oriented on the rotor so as to be concentric to the rotor axis of rotation. Other steps may comprise providing an interior rotor flow path beginning at an input end of the rotor. The interior rotor flow path may be in communication with the plurality of radial flow paths such that when a fluid is introduced at the input end of the rotor and the rotor is rotated around a rotor axis then a boundary layer is formed on the rotor elements. Molecular forces within the fluid induce fluid flow directed radially outwardly and angled with respect to the rotor axis through the plurality of radial flow paths. Other steps may comprise providing an exterior rotor flow path surrounding the rotor elements to receive the fluid flow from the plurality of radial flow paths and to direct spiraling flow induced around the rotor and/or providing a fluid output path for the spiraling flow from the exterior rotor flow path adjacent an output end of the rotor.

The method may further comprise mounting the rotor within a tubular housing section such that the rotor axis is positioned centrally within the tubular housing section. The method may further comprise mounting a plurality of rotors within each of a plurality of tubular housing sections and providing the plurality of rotors with a corresponding plurality of rotor elements.

The method may further comprise providing a fluid transition region between the plurality of rotors which is shaped to smoothly guide fluid from one tubular housing section to another tubular housing section and/or providing a radial bearing in the fluid transition region with one or more fluid flow paths angled in line with the spiraling flow to receive and smoothly direct the spiraling fluid flow through the transition region.

This summary is not intended to in any way be a limitation with respect to the features of the invention as claimed. The elements discussed above can be more readily observed and understood in the detailed description of the preferred embodiment and in the claims.

BRIEF DESCRIPTION OF DRAWINGS

For a further understanding of the nature and objects of the present invention, reference should be had to the following detailed description, taken in conjunction with the accompanying drawings, in which like elements may be given the same or analogous reference numbers and wherein.

While the present invention will be described in connection with presently preferred embodiments, it will be understood that it is not intended to limit the invention to those embodiments. On the contrary, it is intended to cover all alternatives, modifications, and equivalents included within the spirit of the invention.

GENERAL DESCRIPTION AND PREFERRED MODES FOR CARRYING OUT THE INVENTION

Figure 1:
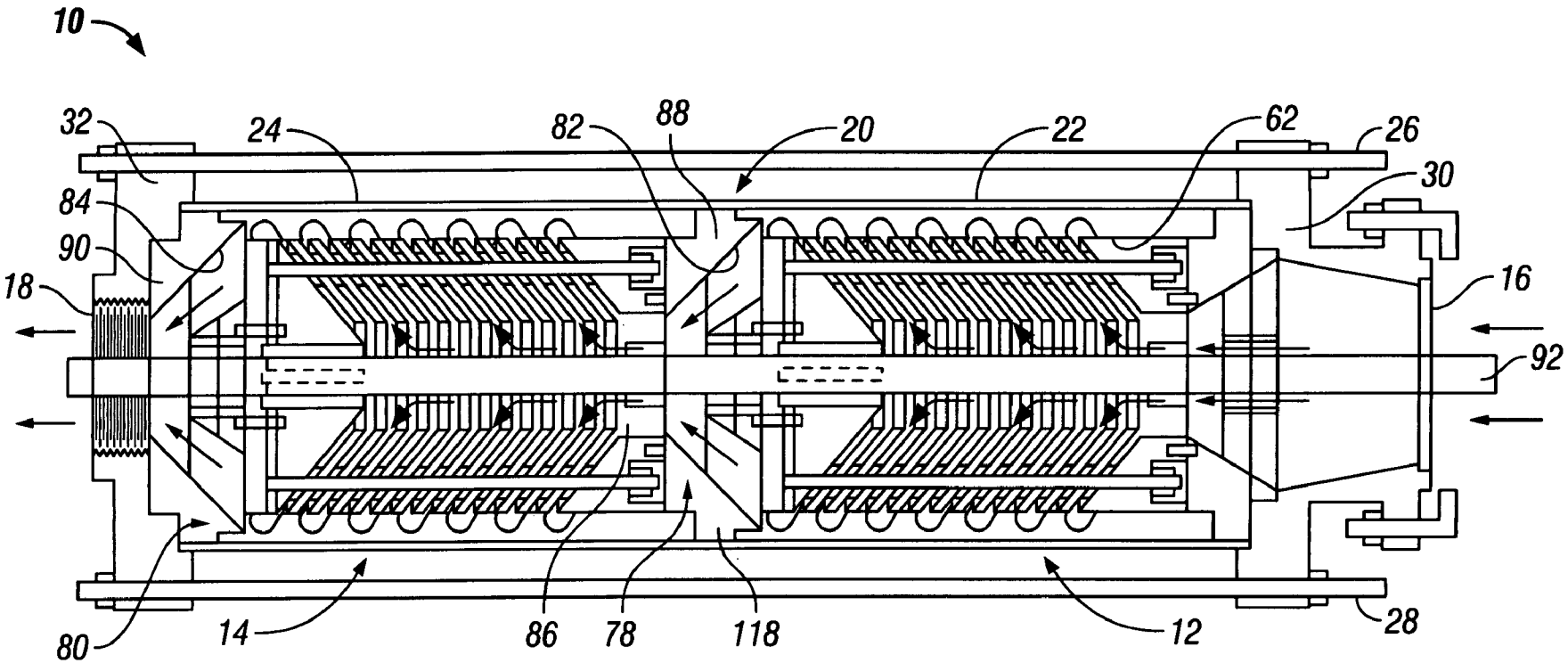
FIG. 1 is an elevational view, in section, showing two stages of a boundary layer turbine pump in accord with one possible embodiment of the present invention.

Referring now to the figures, and more particularly to FIG. 1, there is shown an embodiment of multistage boundary layer pump 10 in accord with the present invention. Pump 10 as shown comprises first boundary layer pump stage 12 and second boundary layer pump stage 14 axially interconnected together. The details and operation of multistage boundary layer pump 10 which permit the unique end-to- end interconnection of multiple boundary layer pump stages is discussed hereinafter. While only two boundary layer pump stages are shown in FIG. 1, it will be understood that many more boundary layer pump stages may be interconnected end-to-end in a similar manner as that shown in FIG. 1. Moreover, each subsequently connected boundary layer pump stage may be identical or substantially identical to the second boundary layer pump stage 14, if desired. First boundary layer pump stage 12 may utilize a different inlet 16 to mate with surrounding equipment as desired. Accordingly, for use in submersible wellbores to pump fluids from a significant depth to the surface, the number of boundary layer pumps utilized may be selected to provide the desired pumping head while still maintaining the flow rate of each pump.

As a general overview of operation, fluid enters multistage boundary layer pump 10 at fluid inlet 16, travels through tubular housing 20, and exits at fluid outlet 18. Tubular housing 20, in this embodiment, comprises a first tubular housing section 22 for boundary layer pump stage 12 integral to a second tubular housing section 24 for boundary layer pump stage 14. If desired, each stage might comprise individual housing sections which are interconnectable together rather than a single tubular housing for the multiple boundary layer pump stages. Fluid flow arrows indicate generally the direction of fluid flow through multistage boundary layer pump 10.

An outer support frame comprising bolts 26 and 28 which secure end pieces 30 and 32 together on opposite ends of tubular housing 20 is shown and may be used for conveniently testing, changing out components, and changing the number of boundary layer stages of multistage boundary layer pump 10 as desired. However, the outer support frame may be modified, eliminated, or altered as desired depending on the preferred usage of multistage boundary layer pump 10.

Figure 2:
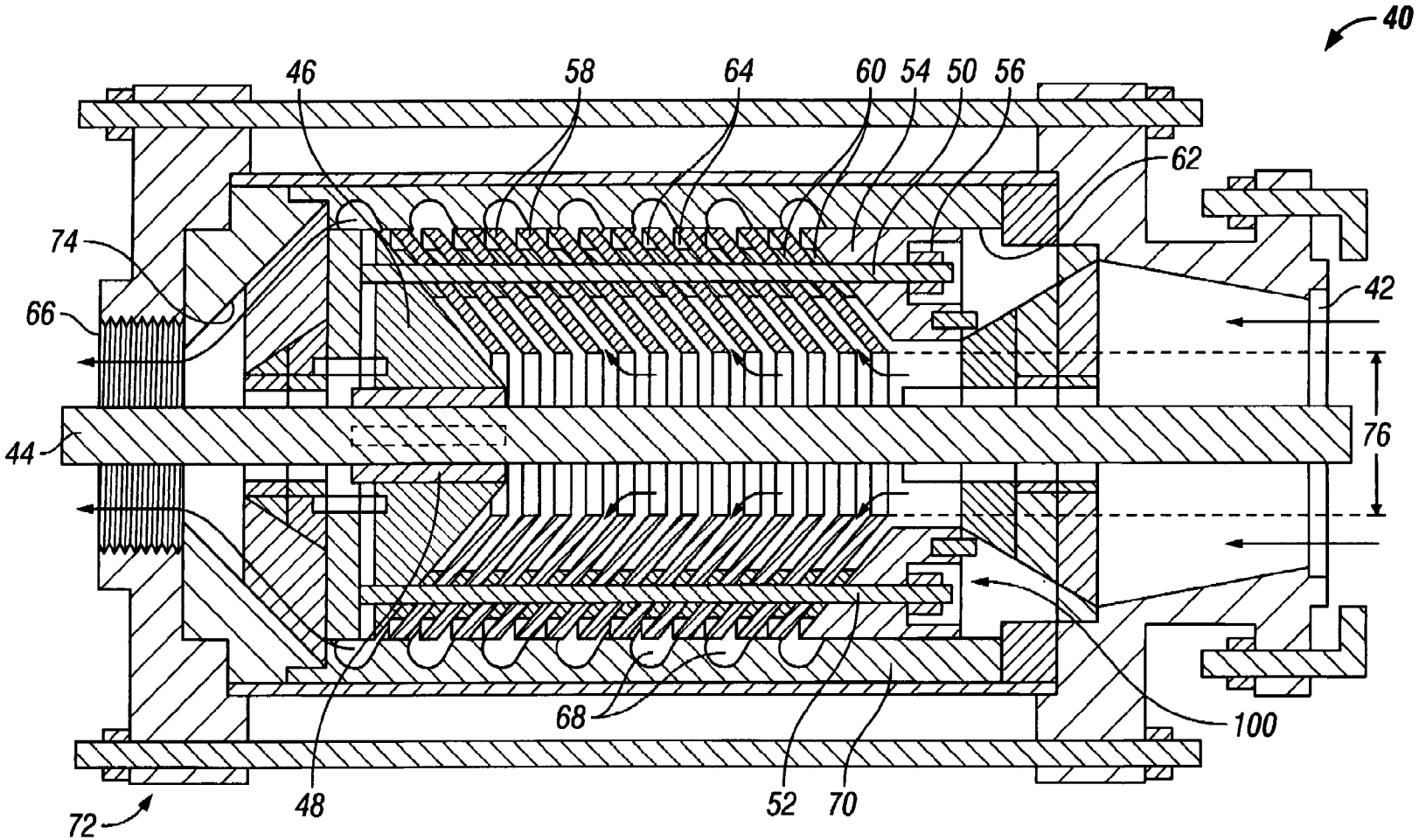
FIG. 2 is an enlarged view of a single stage boundary layer turbine pump in accord with one possible embodiment of the present invention.
Figure 3:
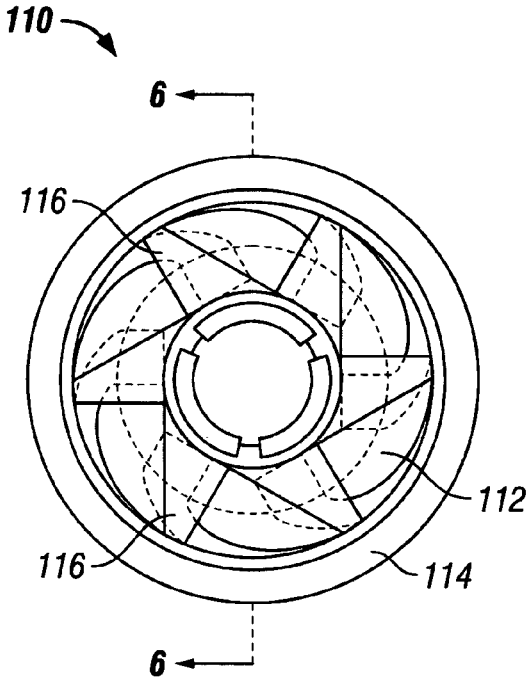
FIG. 3 is an end view, partially with hidden lines, showing one end of a radial bearing for use in a boundary layer turbine pump in accord with one possible embodiment of the present invention.
Figure 4:
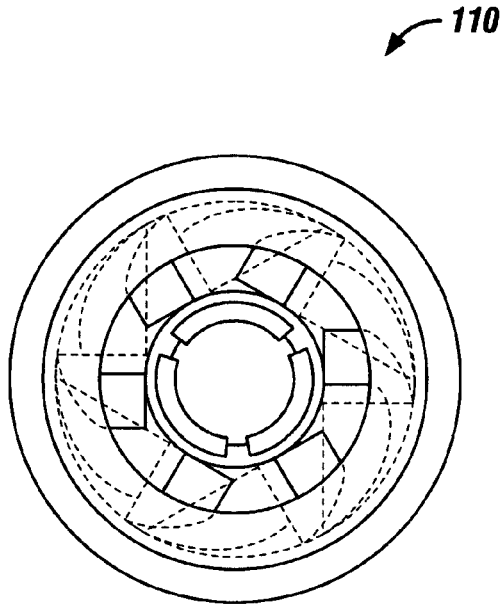
FIG. 4 is an end view, partially with hidden lines, showing the opposite end of the radial bearing of FIG. 3 for use in a boundary layer turbine pump in accord with one possible embodiment of the present invention.
Figure 5:
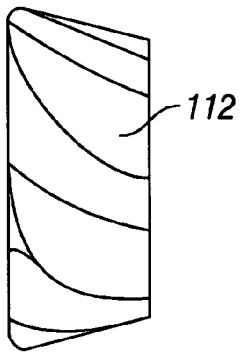
FIG. 5 is an elevational view of a diffusor for the radial bearing assembly of FIG. 3 and FIG. 4 in accord with one possible embodiment of the present invention.
Figure 6:
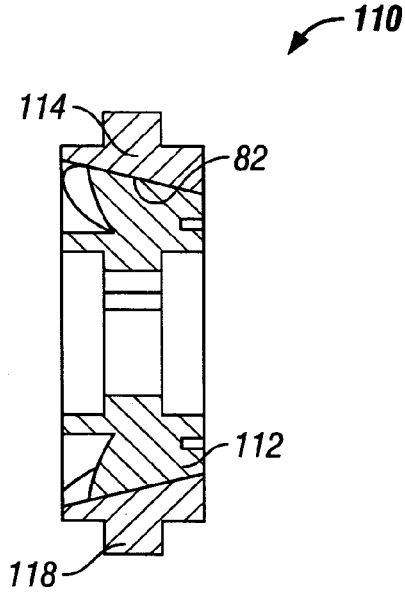
FIG. 6 is an elevational side view, in cross-section, of the radial bearing assembly of along lines 6—6 of FIG. 3 in accord with one possible embodiment of the present invention.
Figure 7:
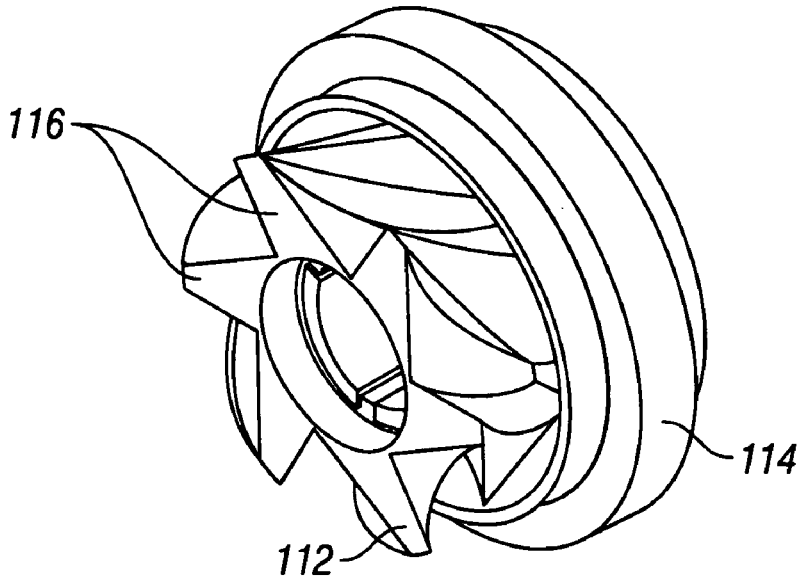
FIG. 7 is an isometric view of the radial bearing of FIG. 3, FIG. 4, FIG. 5 and FIG. 6 in accord with one possible embodiment of the present invention.

An enlarged view of one possible embodiment of a first boundary layer pump stage 40 is shown in FIG. 2. Operation of all boundary layer stages utilized in a multiple stage boundary layer pump may preferably be substantially the same although as noted above the suction pump inlet 42 for the first boundary layer pump stage may be varied in some applications as may be desired such as for interconnecting with existing or standard equipment.

In this embodiment, drive shaft 44 extends through first boundary layer pump stage 40 and may be driven by a motor (not shown) such as a downhole submersible pump drive motor. Drive shaft 44 may then be utilized to rotate end cone 46. In this embodiment, keys 48 secure drive shaft 44 to end cone 46 for rotation therewith but other suitable means may also be utilized for this purpose. Through bolts or studs, such as bolts or studs 50 and 52, extend from end cone 46 to end ring 54 where they may be secured utilizing threaded nuts such as threaded nut 56. A plurality of circumferentially spaced bolts including bolts 50 and 52 may be utilized for this purpose. The bolts are utilized to secure rotor elements 58 in position to form the pump rotor 100. The radial positions, diameter, cross-sectional shape, number, and other features the bolts may be altered as desired. Various prior art documents, some of which are mentioned earlier, discuss different means for securing rotor elements together and/or to rotor 100 and/or to a drive shaft. Accordingly, other means may be utilized for securing rotor elements to form pump rotor 100. In this embodiment, fifteen substantially identical conical rotor elements 58 are secured between end cone 46 and end ring 54. Rotor elements 58 may be spaced axially apart from each other utilizing spacers 60 positioned between each rotor element. It should be mentioned here that while it is anticipated that rotor elements are secured together, that the general means for doing so, the shapes of the rotors including internal and external profiles, the shape of internal wall 62 (shown in this example to be substantially cylindrical except for rifling or spiral grooves as described hereinafter) may vary. Each rotor element 58 may vary in size or shape. In this embodiment, each of spaced apart radial fluid flow paths 64 defined by rotor elements 58 are substantially parallel with respect to each other but this may not be the case if different size, width, shaped, internal diameter, or external diameter rotor elements are utilized.

However, in accord with a presently preferred embodiment of the present invention at least some, and more likely all rotor elements 58 may preferably comprise at least a portion thereof which is conical or dome-shaped for purposes of producing within a limited space or diameter an axial flow component for fluid which is also directed radially outwardly in the plurality of radial fluid paths 64 defined between the axially spaced apart rotor elements 58 to thereby provide an axial discharge boundary layer pump. As used herein, conical refers to a three dimension cone, or portion thereof, with sides which may be defined by straight lines. Dome-shaped is used to describe any curved, convex, concave, s-curved, exponential curve, variable curve or other shape elements or portions thereof which are radially symmetrical as viewed from the end.

If unlimited space were available, and if axial pump multistaging were unnecessary, then the direction of fluid flow from a prior art boundary layer pump could simply be changed by gradual bends in the output flow pipe in which the fluid flows without significantly affecting the energy that had been imparted to the fluid. However, by utilizing the axial flow component imparted to the fluid, the pressurized fluid may be directed within the confines of the pump chamber itself to an axially positioned outlet, such as fluid outlet 66, and thereby provide an axial discharge for boundary layer pump 40 in accord with the present invention. The subsequent discussion lists several components of boundary layer pump 40 which may be utilized in concert but which may also be used independently for smoothly directing the fluid flow axially. As Tesla noted, to effect efficiency in a boundary layer pump, sudden changes in velocity while the fluid is receiving energy from rotor 100 should be avoided. Accordingly, in one embodiment of the present invention, boundary layer pump 40 comprises components as discussed in more detail hereinafter which are designed to cooperate to impart kinetic energy to fluid from rotor 100 and to increase the axial velocity component of the fluid flow by directing of fluid movement in as smooth manner a manner as possible and without decreasing the overall magnitude of the kinetic energy (one-half mass times velocity squared) and/or the total kinetic and potential energy imparted to rotor 100. Energy is imparted from rotor 100 to the fluid as the fluid is carried by rotor 100 in accord with boundary layer pump operation and as the fluid is accelerated radially outwardly by rotor 100. Other discussions of boundary layer pumps, some of which are provided herein, are available to show that the radial distance or radius of rotor 100 and the rotational speed of rotor 100 largely determine the amount of energy imparted from rotor 100 to the fluid. Bournelli's equation which relates pressure, speed, and height at two points in a steady-flowing, non-viscous, incompressible fluid provides some insights into transforming the energy imparted to the fluid by rotor 100 such that the axial component of velocity may be increased in the present invention as desired to provide an axial discharge boundary layer pump within a confined space.

$$P_1+\tfrac{1}{2}\rho v_1^2+\rho g y_1=P_2+\tfrac{1}{2}\rho v_2^2+\rho g y_2$$

where P=pressure, v=velocity

ρ=density g=gravitational force y=height and $\tfrac{1}{2}\rho v^2$=kinetic energy where in boundary layer pump 40 the velocity vector has an axial component and a radial component and an overall magnitude.

Figure 8:
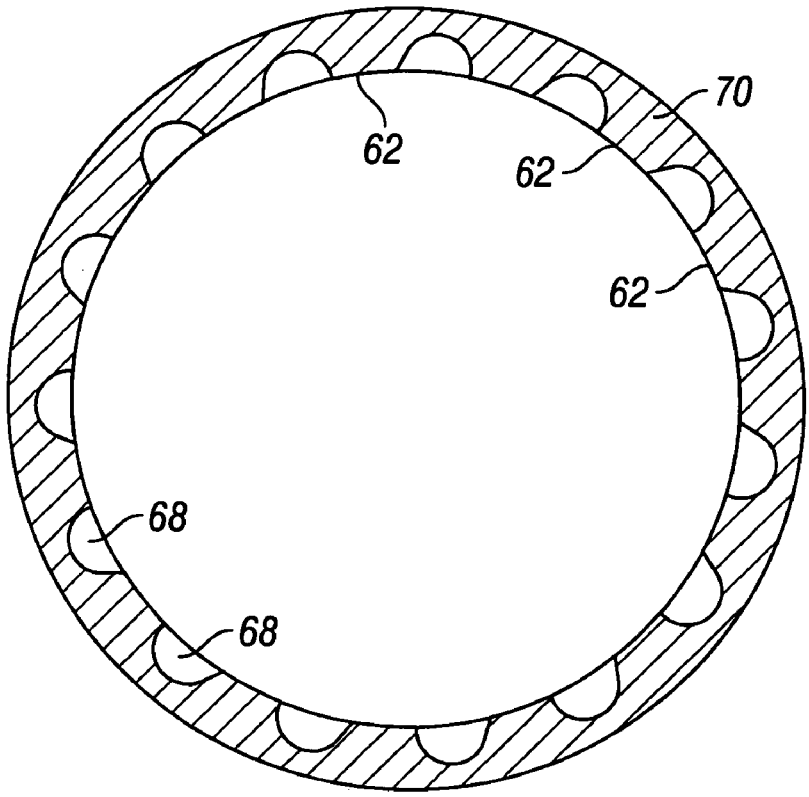
FIG. 8 is an elevational view, in cross-section, taken perpendicular to the axis of rotation, of the rotor housing or stator with the rotor removed in accord with one possible embodiment of the present invention.
Figure 9:
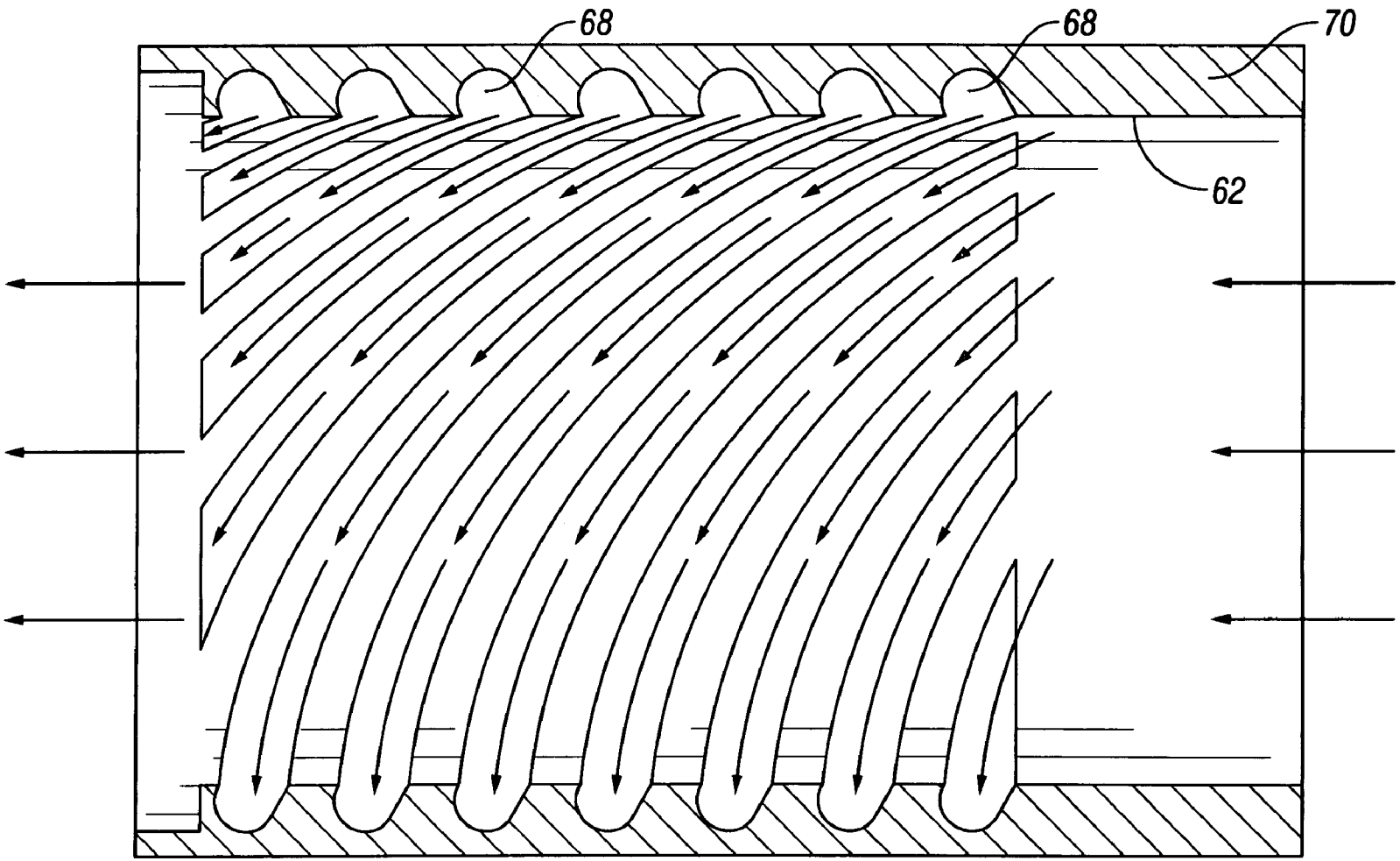
FIG. 9 is an elevational view, in cross-section, taken parallel to the axis of rotation, of the rotor housing or stator of FIG. 8 with the rotor removed in accord with one possible embodiment of the present invention.

In the embodiment shown in FIG. 1 and FIG. 2, rotor elements 58 are conical rings which are angled at forty-five degrees with respect to the axis of rotation of rotation. In this embodiment, the boundary layer effect induces fluid flow through radial passageways 64 at an angle of forty-five degrees. In one embodiment of the invention, a plurality of spiraling fluid paths 68 are provided which encircles rotor 100 and receive the fluid flow to which energy has been imparted so as to smoothly guide the fluid flow toward fluid outlet 66. FIG. 2, FIG. 8, and FIG. 9 show one possible embodiment for providing spiraling fluid paths 68 by forming channels or grooves in interior cylindrical wall 70. The grooves may be formed in a helix which has a constant angle of approximately forty-five degrees so as to mate with the angle of radial passageways 64. As well, the channels, grooves, rifling, threads, or the like which form flow paths 68 may preferably be concentric with and constant in radius from the axis of rotation of rotor 100 until transitioning while retaining energy at fluid output 66 which may lead to an input to a subsequent pumping stage. While one presently preferred embodiment is shown, it will be understood that the invention is not limited to this particular configuration.

Numerous different possibilities exist for variations in wall 70, radial flow paths 60, and fluid paths 68 to provide a fluid with kinetic energy wherein the axial velocity vector component may continuously increase without decreasing significantly the magnitude of the kinetic energy while experiencing the benefits of a boundary layer pump.

As one possible construction variation, the angle of the spiral fluid paths may change. For instance, it may be desirable that the angle of the spiral of fluid path 68 smoothly increase as the fluid flow path nears fluid output 66 so that the axial velocity component of the kinetic energy increases significantly by gently redirecting the direction of flow path 68. This could be matched, if desired, by a decreasing angle of radial flow paths 60 formed between rotor elements 58, e.g. down to thirty degrees' or any other selected angle. Alternatively, radial flow paths 60 may be oriented so as to be greater than forty-five degrees, e.g. sixty degrees whereby the magnitude of the velocity vector in the radial direction may be initially increased as compared to the velocity vector in the axial direction. The angle of spiral fluid path 68 may then be utilized to smoothly redirect the direction of the fluid flow axially without significantly reducing so produced fluid kinetic energy. Moreover, instead of one or more spiral fluid paths 68 formed within wall 70, a volute region around rotor 100 may be utilized with wall 70 being substantially smooth. Or a combination of a volute section and fluid spiral paths 68 may be utilized. Moreover, while wall 70 is shown as cylindrical in this embodiment, wall 70 could have other preferably smooth shapes such as rounded, venturi-shaped, concave, or the like, as desired, to thereby gradually direct fluid in the desired direction such as to provide an axial discharge from boundary layer 40. Moreover, wall 70 may also be conical so that in combination with an increasing angle of fluid path 68 and radial flow paths 60 the energy in the fluid is increasingly directed axially so as to smoothly direct the overall fluid radially inwardly before leaving outlet 66. It will be noted that in one presently preferred embodiment as shown in FIG. 1 and FIG. 2 transition section 72 may include conical wall 74. In yet another embodiment, spiral grooves 68 may not be utilized at all whereby the shape of internal wall 62, which may be cylindrical, conical, venturi-shaped or the like may be utilized to largely redirect the energy of the fluid flow in the axial direction. Accordingly, while one possible embodiment of the present invention is as shown, it will be appreciated that numerous constructions and methods may be utilized for providing a compact radial discharge axial pump 40 in accord with the present invention.

Other information concerning boundary layer pumps is relevant for determining the sizes and positioning of various pump components. For instance, the article "Tesla Pump Comments"by George Wiseman and Published by Twenty First Century Books, P.O. Box 2001, Breckenridge, Colo. 80424-2001, describes pumping effects of features such as inner hole diameter 76 of rotor elements 58, the number of rotor elements 58, rotor element thickness, various means for mounting rotor elements 58 to a shaft (if desired although in the present embodiment the rotor elements are not mounted directly to a shaft), outer volute and housing or volume which surrounds rotor 100 (which for instance would apply to the size of channels 68 in the pictured embodiment but would also apply if channels 68 are not utilized and a volume is provided around rotor 100), inlet 42 and outlet 66 sizes, rotational speeds, the relationship of pressure/volume and horse power, and the general pump formula. The values of these components require knowledge of the particular pumping application. Other helpful boundary layer pump design information may include the unclassified article "Performance of Multiple-Disk-Rotor Pumps with Varied Interdisk Spacings," by Joseph H. Morris, David W. Taylor, Naval Ship R&D Center Aug. 1980, Report No DTNSRDC-80/008, Govt Accession No AD-A088010, Naval Sea Systems Command (SEA 05R14), Washington, D.C. 20362, which describes disk-rotor pumps having various configurations with interdisk spacing ranging from 0.006 to 0.26 inches which were investigated at operating speeds from 3550 to 7000 revolutions per minute whereby operating data for the pumps with the various rotors is provided. It is noted that the report concludes that good performance at wide interdisk spacings was obtained. A review of that data indicates that a fairly wide range of interdisk spacings may be utilized with good pump performance wherein the range utilized may be selected for the fluids to be pumped. Because boundary layer pump 40 operates on similar boundary layer principals, the above information is useful for determining the various factors for a desired pump output of boundary layer pump 40 in accord with the present invention.

As discussed hereinbefore, in one embodiment of the present invention it is desirable to provide a multistage boundary layer pump, one possible embodiment of which is shown in FIG. 1. Accordingly, characteristics of a transition zone, such as transition zone 72 of FIG. 2 or transition zones 78 and 80 in FIG. 1, are utilized to smoothly transition the energy in fluid from one pumping stage to the next pumping stage without substantial energy loss.

In FIG. 1, it is seen that transition zones 78 and 80 comprise conical walls 82 and 84 which smoothly direct fluid flow from the volute or region or channels 22 which surround the rotor. Conical walls provide a simple and smooth transition but other shapes may also be utilized such as concave, convex, s-shaped, french curved walls, and the like, as desired. The diameter of inlet region 86 may be selected as desired based on the relative diameter or combined diameters of channels 22 or the volute region surrounding the rotors to thereby provide as smooth and gradual changes to the fluid velocity and direction as possible. In one embodiment of the invention for use in a wellbore, the outer diameter of housing 20 is approximately four and five eighths inches and relative size of the components shown in FIG. 1 is substantially proportional to that shown. Fifteen stator elements are utilized per stage with one-eighth inch spacing. In testing of this design, it was found that the best efficiency for 4500 TDH (total dynamic head) was at 1750 BPD (barrels per day). Utilizing water with air infusion it was found stage efficiency was 13% with 1.8 HP (horsepower) at 60 Hz. Existing technology for downhole applications utilize 60 Hz to avoid excessive vibration but multistage boundary layer pump 10 was operated at 90 Hz without noise or vibration. Thus, the flow rates, horsepower, and pumping capabilities can be increased by use of higher RPM than is possible utilizing prior art downhole pumps. In other testing, with 50% entrained gas in the fluid pumped by pump 10, no cavitation was produced. In prior art downhole pumps, this amount of gas in fluid may cause significant problems.

Other elements utilized in transition zones 78 and 80 for the present embodiment of boundary layer multistage pump 10 comprise bearing assemblies 88 and 90 for the corresponding rotors. One presently preferred embodiment for bearing assembly 110 is shown in FIG. 3, FIG. 4, FIG. 5, FIG. 6, and FIG. 7. Bearing assembly 110 comprises a radial bearing with stator 114 and diffuser 112. Radial bearing assembly 110 radially supports drive shaft 44 (shown in FIG. 2) or drive shaft 92 (shown in FIG. 1) with respect to the pump. Diffuser 112 mates with the drive shaft and rotates within stator 114 along mating conical surfaces within stator 114 and diffuser 112. Due to the conical surfaces which are also utilized for directing fluid flow, thrust support in one direction along drive shaft 92 is also provided by radial bearing assembly 112. Stator 114 fits between the pumping stages and may utilize ring 118 or other means to axially and radially affix stator 114 with respect to tubular housing 20. Diffuser 112 also acts to maintain laminar flow and smoothly directs the flow from one pumping stage to the next. The fluid flow through radial bearing 110 cools and lubricates the bearing. Within transition sections 78 and 80, the fluid flow is directed to conical surfaces 82 and 84 (see FIG. 1 and FIG. 6) within stator 114 and preferably through fins 116 of diffuser 112. Fins 116 may preferably be oriented in line with the direction of laminar flow so as to guide the flow to the next stage. Diffuser 112 may be designed to rotate to good effect as desired. The subsequent stages then start with the released fluid flow and pressure of the previous stage, whereby the each stage compounds the pressure to the next stage. The number of stages depends on the total lift required and the head for the application and the volume of the fluid. These are a function of the diameter stator element 58 rim speed, viscosity, solids (size), the number of stator elements 58, and the spacing of stator elements 58. It will be seen especially clearly in FIG. 7 that a continuous geometry is utilized through the transition region from the end of the last stator element 58 to the intake of the first stator element 58 in the next stages. In one preferred embodiment, the transition zone provides a continuous spiraling flow that ensures the fluid motion is smoothly directed to the next pumping stage. While radial bearing assembly 110 is a presently preferred embodiment for downhole pumping, other bearing assemblies may also be utilized.

In summary, referring to multistage boundary layer pump 10 in FIG. 1 generally and FIG. 2 for enlarged component details, fluid flow enters input 16 (FIG. 1) and flows to the rotor elements 58 (FIG. 2) where rotational energy of rotor 100 (FIG. 1) is imparted to the fluid as the fluid is accelerated radially outwardly by rotor 100 through radial flow passages 64 between spaced apart stator elements 58. The fluid exits rotor 100 in this embodiment into a plurality of spiraling flow paths 68 which surround rotor 100. The fluid has an axial velocity component due to the angle of flow paths 68. The spiraling flow paths may be utilized to maintain laminar fluid flow at about the same axial velocity, if that is the desired design goal. At the end of the spiraling flow paths 68, the fluid is directed along conical surfaces, such as conical surface 82 of stator 80 as shown in FIG. 1 or within stator 114 shown in FIG. 6 wherein stator 114 comprises part of the radial bearing assembly utilized to support the drive shaft. The fluid is therefore smoothly directed to the next pumping stage 14 whereupon the same process occurs and the pump pressure increases.

Thus, the foregoing disclosure and description of the invention is therefore illustrative and explanatory of one or more presently preferred embodiments of the invention and some possible variations thereof, and it will be appreciated by those skilled in the art that various changes in the design, organization, order of operation, means of operation, equipment structures and location, methodology, and use of mechanical equivalents, as well as in the details of the illustrated construction or combinations of features of the various elements, may be made without departing from the spirit of the invention.

For instance, the present invention may be utilized for many pumping problems. For example, blood cells, in a mechanical sense, are essentially thin-skinned sacks filled with fluids so that boundary layer pumps which are very kind to shear-sensitive fluids may be highly suitable for such applications. Although modem blood pumps greatly reduce damage to blood cells as compared to earlier designs, the fragile blood cells may be damaged by the high speed rotation of even modem impeller designs as used in rotary blood pumps such as the small or miniature ventricle assist pumps that are presently being implanted and which have been found to decrease the load on the heart which often promotes self-healing and/or for other purposes. Such VAD (ventricle assist device) pumps are very small and operate at relatively high revolutions per minute in the range of about 10,000 RPM. The lack of blades in the boundary layer pump is likely to reduce blood damage even further and the axial discharge permits use of current surgical procedures for implantation in line with the artery as a VAD (ventricle assist device). For this purpose, the rotor could be magnetically levitated to avoid problems of blood clots at the bearings. The outer tubular could be plastic. Permanent magnet pellets may be attached to outermost edges of the stator elements and the outer tubular surrounded by a stator coil to thereby magnetically induce rotation of the rotor and provide the present invention as a miniaturized electric blood pump VAD. The present invention can be adapted to many possible uses. A short list of such uses may include uses for pumping fluids such as water, gases, and multiphase fluids such as sewage, oil, and gases. The present invention may also be adapted for use as a driver for propulsion such as in naval or aerospace applications. Moreover the present invention may be utilized as an internal combustion engine where, for example only, combustion chambers may formed between the stages to provide heated gases to drive the rotors of the stages. The present invention may be utilized as a turbine to generate electricity from steam or for other purposes as desired.

The drawings are intended to describe the concepts of the invention so that the presently preferred embodiments of the invention will be plainly disclosed to one of skill in the art but are not intended to be renditions of finalized product designs and may include simplified conceptual views as desired for easier and quicker understanding or explanation of the invention. It will be seen that various changes and alternatives may be used that are contained within the spirit of the invention. Moreover, it will be understood that various directions such as "upper," "lower," "bottom," "top," "left," "right," "inwardly," "outwardly," and so forth are made only with respect to easier explanation in conjunction with the drawings and that the components may be oriented differently, for instance, during transportation and manufacturing as well as operation. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

The invention claimed is:

1. A rotary machine operable for transformation of energy between rotary mechanical energy and fluid kinetic energy, comprising:

a drive shaft;

a tubular housing defining a fluid input and a fluid output and a rotor operating region;

a rotor mounted within said rotor operating region for rotation about a rotor axis of rotation through said drive shaft, said rotor comprising a first rotor end and a second rotor end, said axis of rotation extending between said first rotor end and said second rotor end, said rotor operating region being positioned between said fluid input and said fluid output; and a plurality of rotor elements for said rotor, said plurality of rotor elements being axially spaced from each other along said rotor, said plurality of rotor elements comprising a plurality of conical surfaces or domed surfaces oriented on said rotor so as to be concentric to said rotor axis of rotation, said plurality of rotor elements defining therebetween a plurality of radial flow paths, said plurality of rotor elements defining a plurality of centrally positioned apertures that collectively define an unrestricted interior opening that surrounds said drive shaft and connects to said plurality of radial flow paths to permit radially outwardly fluid flow through said plurality of radial flow paths, said unrestricted interior opening receiving fluid flow from said fluid input to provide said radially outwardly fluid flow through said plurality of radial flow paths.

2. The rotary machine of claim 1, wherein said plurality of radial flow paths are oriented parallel or substantially parallel with respect to each other and are angled between zero and ninety degrees with respect to said rotor axis of rotation.

3. The rotary machine of claim 1, wherein said plurality of rotor elements comprise relatively smooth radially symmetrical surfaces without blades.

4. The rotary machine of claim 3, wherein said tubular housing for said rotor operating region has a substantially straight or straight tubular axis about which an interior surface of said tubular housing is substantially concentric or concentric, said straight tubular axis and said straight drive shaft being coaxial with respect to each other.

5. The rotary machine of claim 1, wherein said fluid input is on an opposite end of said tubular housing from said fluid output.

6. The rotary machine of claim 5, further comprising a straight drive shaft, said drive shaft extending through said fluid input and said fluid output.

7. The rotary machine of claim 1, wherein said tubular housing further defines a peripheral fluid flow path along a periphery of said rotor, said peripheral fluid flow path being in communication with said fluid input and said fluid output, said tubular housing constraining fluid to move with an axial direction vector component through said fluid input into said tubular housing, through said peripheral flow path, out of said tubular housing through said fluid output.

8. The rotary machine of claim 7, wherein said peripheral flow path is substantially concentric with said rotor.

9. The rotary machine of claim 8, further comprising a substantially cylindrical interior wall around said rotor, said interior wall defining at least a portion of one or more helical channels, said one or more helical channels defining at least a portion of said peripheral flow path.

10. The rotary machine of claim 1, further comprising a generally cylindrical interior surface inner surface which surrounds said rotor.

11. The rotary machine of claim 10, wherein said generally cylindrical interior surface defines at least a portion of one or more spiraling channels.

12. The rotary machine of claim 11, wherein said one or more spiraling flow paths each comprise a helical flow path with turns of constant slope and constant distance from said rotor axis of rotation.

13. The rotary machine of claim 1, wherein at least a portion said plurality of rotor elements are substantially identical.

14. The rotary machine of claim 1, further comprising a radial bearing for said rotor, said radial bearing comprising one or more flow paths therethrough.

15. The rotary machine of claim 1, further comprising a plurality of tubular housing sections each defining a fluid input and a fluid output and a rotor operating region, said plurality of tubular housing sections being axially oriented with respect to each other such that a respective output of each tubular section is connected to a respective input of another tubular section;

a respective rotor for each of said plurality of tubular housing sections mounted within said rotor operating region for rotation about a rotor axis of rotation, and a respective plurality of spaced rotor elements for each respective rotor, and each respective plurality of spaced rotor elements defining a plurality of radial flow paths therebetween.

16. A rotary machine operable for transformation of energy between rotary mechanical energy and fluid kinetic energy, comprising:

a tubular housing;

a rotor mounted within said tubular housing for rotation about a rotor axis of rotation; and a plurality of rotor elements for said rotor, said plurality of rotor elements being axially spaced with respect to each other and being concentric with said rotor axis of rotation, said plurality of rotor elements defining a plurality of radial flow paths therebetween, said tubular housing further comprising en interior portion wherein one or more spiraling fluid flow channels are formed therein, said one or more spiraling flow channels encircling an outer periphery of said plurality of rotor elements and being oriented to accommodate an axial fluid flow velocity component, said plurality of radial flow paths being in fluid communication with said one or more spiraling fluid flow channels.

17. The rotary machine of claim 16, wherein at least a portion of said one or more spiraling flow channels comprise a helical flow path with turns of constant slope and constant distance from said rotor axis of rotation.

18. The rotary machine of claim 16, further comprising a substantially cylindrical interior wall around said rotor, said substantially cylindrical interior defining at least a portion of said one or more spiraling fluid flow channels.

19. The rotary machine of claim 18, wherein at least a portion of each of said plurality of rotor elements comprises a conical surface or a domed surface.

20. The rotary machine of claim 16, wherein said tubular housing further defines a fluid input and a fluid output and a rotor operating region, said being rotor mounted within said rotor operating region, said rotor operating region being positioned between said fluid input and said fluid output such that one end of said rotor is adjacent to or within said fluid input and an opposite end of said rotor is adjacent to or within said fluid output.

21. The rotary machine of claim 20, wherein said tubular housing is substantially straight with a substantially straight tubular axis, said fluid input being on one end of said tubular housing and said fluid output being on an opposite end of said tubular housing whereby during operation of said rotary machine fluid is constrained to move axially through said tubular housing from said fluid input to said fluid output.

22. The rotary machine of claim 16, further comprising a plurality of tubular housing sections each defining a fluid input and a fluid output and a rotor operating region, said plurality of tubular housings being axially connected with respect to each other such that a respective output may be connected to a respective input;

a respective rotor for each of said plurality of tubular housing sections mounted within said rotor operating region for rotation about a rotor axis of rotation, and a respective plurality of spaced rotor elements for each respective rotor and each respective plurality of spaced rotor elements defining a plurality of radial flow paths therebetween.

23. A rotary machine operable for transformation of energy between rotary mechanical energy and fluid kinetic energy, comprising a plurality of tubular housing sections;

a respective one of a plurally of rotors mounted for rotation within each of said plurality of tubular housing sections, said plurality of rotors being axially aligned or substantially axially aligned with respect to each other;

a plurality of rotor elements for each respective one of said plurality of rotors, said plurality of rotor elements being axially spaced from each, said plurality of rotor elements comprising a plurality of conical surfaces or domed surfaces oriented on said rotor so as to be concentric to said rotor axis of rotation, said plurality of rotor elements defining therebetween a plurality of radial flow paths; and a plurality of fluid transition sections between each of said plurality of rotors, said fluid transition sections defining sloping tubular walls.

24. The rotary machine of claim 23, further comprising a drive shaft extending though said plurality of tubular housing sections.

25. The rotary machine of claim 23, further comprising at least one radial bearing for each respective one of said plurality of rotors, said at least one radial bearing comprising one or more flow paths therethrough.

26. A method for making a rotary machine for transformation of energy between rotary mechanical energy and fluid kinetic energy, comprising:

mounting a plurality of rotor elements onto a rotor, said plurality of rotor elements being axially spaced from each along said rotor, said plurality of rotor elements comprising a conical surface or domed surface oriented on said rotor so as to be concentric to said rotor axis of rotation, said plurality of rotor elements defining therebetween a plurality of radial flow paths angled with respect to an axis of said rotor;

providing an interior or substantially interior rotor flow path beginning at an input end of said rotor, said interior or substantially interior rotor flow path being in communication with said plurality of radial flow paths such that when a fluid is introduced at said input end of said rotor and said rotor is rotated around a rotor axis then a boundary layer is formed on said rotor elements whereby molecular forces within said fluid induce fluid flow directed radially outwardly and angled with respect to said rotor axis through said plurality of radial flow paths such that fluid is discharged from each of said radial fluid flow paths at a predetermined discharge angle;

providing an exterior rotor flow path surrounding said rotor elements to receive said fluid flow from said plurality of radial flow paths and to direct spiraling flow induced around said rotor at said discharge angle or with a smooth change from said discharge angle; and providing a fluid output path for said spiraling flow from said exterior rotor flow path adjacent an output end of said rotor at said discharge angle or with a smooth change from said discharge angle.

27. The method of claim 26, further comprising mounting said rotor within a tubular housing section such that said rotor axis is positioned centrally within said tubular housing section, and providing that said tubular housing section comprises an input end for guiding said fluid to said input end of said rotor and an output end which defines said fluid path output path, said output end being at an opposite end of said tubular housing section from said input end.

28. The method of claim 27, further comprising mounting a plurality of rotors within each of a plurality of tubular housing sections, providing said plurality of rotors with a corresponding plurality of rotor elements comprising a conical surface or domed surface oriented on said rotor so as to be concentric to said rotor axis of rotation, and providing that said plurality of said tubular housing sections are connected end-to-end.

29. The method of claim 28, further comprising providing a fluid transition region between said plurality of rotors which is shaped to smoothly guide fluid from one tubular housing section to another tubular housing section.

30. The method of claim 28, further comprising providing a radial bearing in said fluid transition region with one or more fluid flow paths angled in line with said spiraling flow to receive and smoothly direct said spiraling fluid flow through said transition region.

31. A rotary machine operable for transformation of energy between rotary mechanical energy and fluid kinetic energy, comprising a plurality of tubular housing sections;

a respective one of a plurality of rotors mounted for rotation within each of said plurality of tubular housing sections, said plurality of rotors being axially aligned or substantially axially aligned with respect to each other;

a plurality of rotor elements for each respective one of said plurality of rotors, said plurality of rotor elements being axially spaced from each, said plurality of rotor elements comprising a plurality of conical surfaces or domed surfaces oriented on said rotor so as to be concentric to said rotor axis of rotation, said plurality of rotor elements defining therebetween a plurality of radial flow paths; and at least one radial bearing for each respective one of said plurality of rotors, said at least one radial bearing comprising one or more flow paths therethrough.

* * * * *

UNITED STATES PATENT AND TRADEMARK OFFICE

CERTIFICATE OF CORRECTION

PATENT NO. : 7,192,244 B2
APPLICATION NO. : 11/030467
DATED : March 20, 2007
INVENTOR(S) : Salvatore F. Grande, III et al.

It is certified that error appears in the above-identified patent and that said Letters Patent is hereby corrected as shown below:

Column 25, Claim 10, line 20, delete “inner surface”.

Column 25, Claim 13, line 30, insert --of-- between “portion” and “said”.

Column 25, Claim 16, line 60, delete “en” and replace with --an--.

Signed and Sealed this

Eighteenth Day of March, 2008

JON W. DUDAS
*Director of the United States Patent and Trademark Office*